United States Patent [19]

Fossum

[11] Patent Number: 4,686,648

[45] Date of Patent: Aug. 11, 1987

[54] CHARGE COUPLED DEVICE DIFFERENCER

[75] Inventor: Eric R. Fossum, New Haven, Conn.

[73] Assignee: Hughes Aircraft Company, Los Angeles, Calif.

[21] Appl. No.: 805,505

[22] Filed: Dec. 3, 1985

[51] Int. Cl.[4] ..... G06G 7/00

[52] U.S. Cl. ..... 364/862; 364/807; 357/24; 377/63

[58] Field of Search ..... 364/800, 807, 861–862; 307/444, 607; 357/24; 365/183; 333/165; 377/60–63

[56] References Cited

U.S. PATENT DOCUMENTS

| | | | |
|---|---|---|---|
| 4,085,441 | 4/1978 | Fagan | 364/827 |
| 4,103,333 | 7/1978 | Poirier et al. | 364/862 X |
| 4,104,543 | 8/1978 | Maeding | 307/221 D |
| 4,195,273 | 3/1980 | Prince | 333/165 |
| 4,239,983 | 12/1980 | Edwards et al. | 307/221 D |
| 4,476,568 | 10/1984 | Prince | 377/60 |
| 4,509,181 | 4/1985 | Sauer | 377/63 |
| 4,573,177 | 2/1986 | Petrosky | 377/60 |
| 4,627,084 | 12/1986 | McIver | 377/60 |

*Primary Examiner*—Gary V. Harkcom

*Attorney, Agent, or Firm*—Charles D. Brown; Anthony W. Karambelas

[57] ABSTRACT

A charge packet differencer is implemented in a charge coupled device in such a manner that a first charge packet may be subtracted from a second charge packet thus giving a resultant charge packet equal to the difference between the first and second charge packets. The charge coupled device differencer comprises a semiconductor substrate in which there is formed first and second charge transfer devices, first and second charge substraction mechanisms, and a charge reservoir cooperating to produce a charge packet output representative of the difference between two input charge packets using a gate charge subtraction technique.

18 Claims, 12 Drawing Figures

TO CONTINUATION OF FIG. 3.

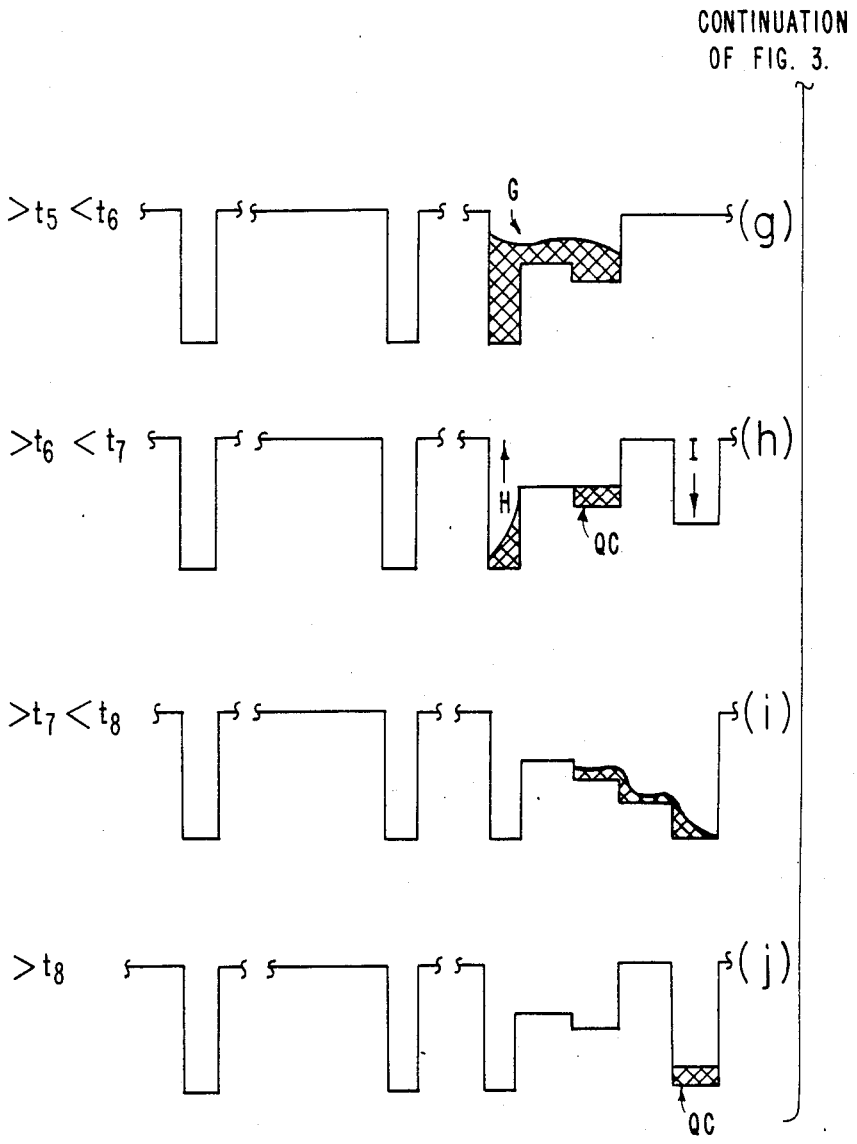
CONTINUATION
OF FIG. 3.
>t5 <t6
G
(g)
>t6 <t7
H
I
QC
(h)
>t7 <t8
(i)
>t8
QC
(j)

CHARGE COUPLED DEVICE DIFFERENCER

BACKGROUND OF THE INVENTION

1. Field of the Invention

The present invention relates to charge coupled devices (CCD) and in particular to the use of such devices for creating a charge packet which is equal to the difference of two input charge packets.

2. Background Art

In the technology of charge coupled devices various techniques have been used to do the arithmetic operation of subtraction. One such example of CCD subtraction is disclosed in U.S. Pat. No. 4,085,441 entitled "Monolithic Implementation of a Fast Fourier Transform" issued Apr. 18, 1978 to John L. Fagan on an application filed Nov. 24, 1976 and assigned to Westinghouse Electric Corporation. The patent issued to Fagan describes a CCD subtractor structure where two input signal voltages are subtracted one from the other using a charge-skimming technique. The resulting charge packet is representative of the difference between the two input voltages and is then converted into an output voltage. However, this structure utilizes input voltages and would not be compatible where discrete input charge packet subtraction is required.

In applications where discrete charge packets are to be subtracted, the most common technique requires the discrete charge packets to be converted into voltages so that the subtraction operation may be performed. An example of the technique of converting charge packets into voltages for subtracting is disclosed in U.S. Pat. No. 4,104,543 entitled "Multichannel CCD Signal Subtraction System" issued Aug. 1, 1978 to Dale G. Maeding on an application filed Feb. 22, 1977 and assigned to Hughes Aircraft Company. The patent issued to Maeding discloses a multichannel CCD structure which permits input signal charge packets to be subtracted one from another by alternately passing them under a common, periodically clamped floating electrode. The voltage assumed by the unclamped floating electrode is the difference between the charges. Hence, an output voltage represents the difference in the quantity of charge in two inputs signal charge packets. To obtain an output signal charge packet representative of the difference between the two input signal charge packets, the output voltage must be reconverted back into a charge packet.

For computationally intensive applications, such as that which might be employed in a focal plane imaging device for image preprocessing, a premium is placed on computing accuracy and real estate consumption. For such applications, the approaches described above for charge packet differencing are cumbersome and undesirable.

In many applications it is preferrable to directly subtract a first input charge packet from a second input charge packet with a resultant charge packet being the difference between the two input charge packets. An example of such a CCD subtractor is disclosed in U.S. Pat. No. 4,239,983 entitled "Non-Destructive Charge Transfer Device Differencing Circuit" issued Dec. 16, 1980 to Edwards et al on an application filed Mar. 9, 1979 and assigned to International Business Machines Corporation. The patent issued to Edwards et al discloses a CCD subtractor circuit wherein input charge packets are substracted using a floating gate electrode structure connected to a common node and diffusion. The input charge packets are represented as a separate pair of spatially separate charge packets which in turn represent positive and negative algebraic values using charge carriers of the same polarity. A disadvantage of such a subtractor circuit is that discrete charge packets must be broken into spatially separate charge packets. Directly inputting two charge packets would result in an output charge packet that would be the addition of the two input charge packets and not the difference.

It is therefore, an objective of the present invention to provide a CCD device for precise differencing of charge packets by using a gate charge subtraction technique which enhances the accuracy and linearity of the resultant charge packet.

It is another objective of the present invention to provide a CCD device which in addition to being a charge subtractor can be used as a charge packet replicator.

A further objective of the present invention is to provide a CCD device which can be used as a charge packet amplifier (or attenuator), individually, or in combination with the subtractor or replicator functions.

SUMMARY OF THE INVENTION

In the present invention, a charge packet differencer is implemented in a charge coupled device structure such that an input charge packet may be subtracted from another input charge packet giving a resultant charge packet equal to the difference between the input charge packets.

The charge coupled device differencer of the present invention comprises a semiconductor substrate in which there is formed a first charge transfer means for receiving and transferring a first charge packet and a second charge transfer means for receiving and transferring a second charge packet. A first charge subtraction means is provided such that a first potential well is formed in the substrate in proportion to the first charge packet. A second charge subtraction means is provided such that a second potential well is formed in the substrate in proportion to the second charge packet. A charge reservoir means is provided for injecting a third charge packet into the formed first and second potential wells and for removing a fourth charge packet from the potential wells.

The removed fourth charge packet is less than the third charge packet when the first charge packet is greater than the second charge packet. The difference between the third and fourth charge packets remains in the second potential well and represents the difference between the first and second charge packets. However, the fourth charge packet equals the third charge packet when the first charge packet is less than or equal to the second charge packet. Therefore there is no difference charge packet which remains in the second potential well.

The present invention comprises a circuit which utilizes vertical charge-coupling between the electrodes and semiconductor surface in addition to the usual lateral charge-coupling to perform the differencing operation. The input charge packets are coupled to precharged electrodes through a gate charge subtraction cycle. Using the charge on the electrode, an output charge packet is formed through surface potential equilibration, though not in the electrode voltage mode normally associated with this charge setting method.

The charge-coupled device differencer of the present invention is useful as a prime functional building block of an array of charge-coupled computers located on a single semiconductor chip. Such a charge coupled device differencer would also find application in focal plane array for processing of image data or in a robot vision system. The present invention having a reduced number of electrodes, occupies less chip real estate, thereby allowing for a reduction in volume and complexity of the image processing system.

Figure 1:
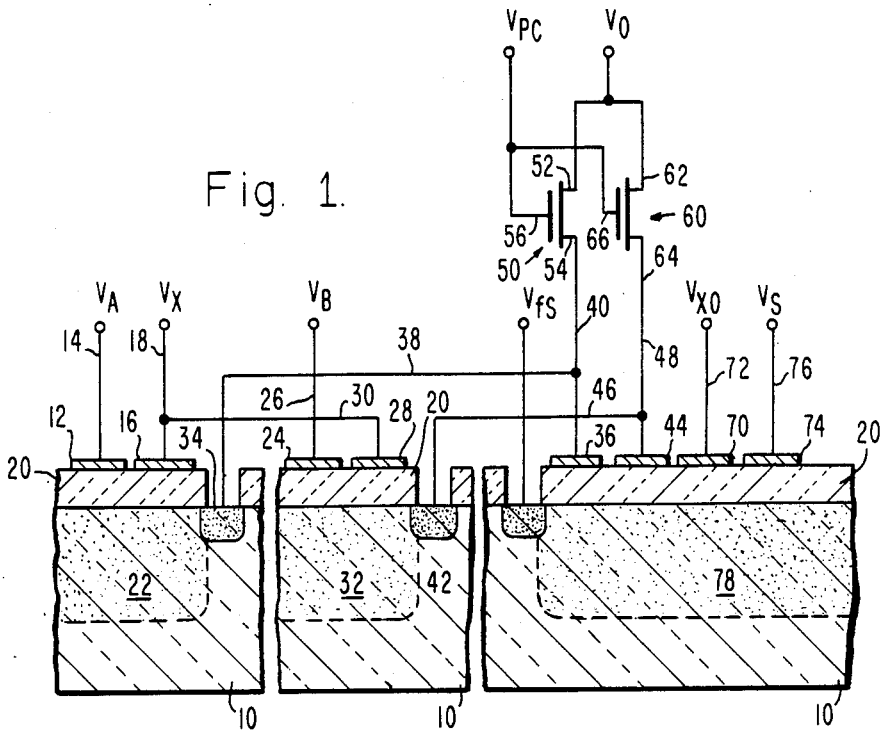
FIG. 1 is a schematic illustration of a charge coupled device differencer.

FIG. *3a* is a simplified schematic illustration of the charge coupled device differencer of FIG. 1 while FIGS. *3b, 3c, 3d, 3e, 3f, 3g, 3h, 3i,* and *3j* illustrate the voltage potential profiles showing the location of charge propagated through the simplified schematic of FIG. *3a,* when charge packet $Q_A$ is greater than charge packet $Q_B$.

DETAILED DESCRIPTION OF THE INVENTION

The present invention comprises a novel charge coupled device differencer. The following detailed description of the preferred embodiment of the invention is provided to enable any person skilled in the art to make and use the present invention.

The charge coupled device differencer of the present invention as illustrated in FIG. 1 is formed on a semiconductor substrate 10. Substrate 10 can be either a p-type or n-type doped semiconductor material, such as silicon. The following description will describe a device having a n-channel configuration using a p-type silicon substrate. However, it is readily apparent to one skilled in the art that a p-channel configuration using a n-type substrate may be constructed from the teaching of the n-channel configuration.

A first charge transfer means is formed on substrate 10 for receiving and transferring a first quantity of charge carriers. The first charge transfer means comprises electrodes 12 and 16 overlying substrate 10. Electrodes 12 and 16 are insulated from substrate 10 by a thin insulating layer 20, which is preferrably a layer of $SiO_2$ perhaps 600 Angstroms thick. Electrodes 12 and 16 may for example be aluminum deposited on top of insulating layer 20 as shown in FIG. 1 or may be heavily doped polysilicon on layer 20. Electrodes 12 and 16 are located adjacent each other above first charge flow channel 22 to permit charge packet transfer between potential wells created below electrodes 12 and 16 in substrate 10. Electrode 12 is coupled to clock signal $V_A$ by lead 14 while electrode 16 is coupled to clock signal $V_X$ by lead 18.

A second charge transfer means is formed on substrate 10 for receiving and transferring a second quantity of charge carriers. The second charge transfer means comprises electrodes 24 and 28 overlying substrate 10. Electrodes 24 and 28 are insulated from substrate 10 by insulating layer 20. Electrodes 24 and 28 are located adjacent each other above second charge flow channel 32. Charge flow channel 32 is structurally separate from charge flow channel 22. Charge carriers, in the form of charge packets, are injected into either one of charge flow channels 22 and 32 and flow respectively therein. Electrode 24 is coupled to clock signal $V_B$ by lead 26. Electrode 28 is connected to electrode 16 by leads 30 and 18, which effectively couples electrode 28 to clock signal $V_X$.

A first charge subtraction means formed on substrate 10 comprises diffusion 34 coupled to electrode 36. Diffusion 34 is located in substrate 10 adjacent the area below electrode 16 thus being adjacent charge flow channel 22. Diffusion 34 is a $n^+$-type diffusion in p-type substrate 10. Diffusion 34 is connected to electrode 36 by lead 38.

Electrode 36 is insulated from substrate 10 by layer 20 and may be of the same composition as electrodes 12, 16, 24 and 28. Electrode 36 has a surface area defined as $A_1$. Electrode 36 is coupled by lead 40 to a first precharge means 50. The first precharge means controls the placing of a charge on electrode 36 from a voltage source (not shown in FIG. 1). This voltage source has an output voltage, $V_0$.

A second charge subtraction means formed on substrate 10 comprises diffusion 42 coupled to electrode 44. Diffusion 42 is located in substrate 10 adjacent the area below electrode 28, thus being adjacent charge flow channel 32. Diffusion 42, like diffusion 34, is an $n^+$-type diffusion in p-type substrate 10. Diffusion 42 is connected to electrode 44 by lead 46.

Electrode 44 is insulated from substrate 10 by layer 20 and may be of the same composition as electrodes 12, 16, 24, 28 and 36. Electrode 44 has a surface area defined as $A_2$. Electrode 44 is coupled by lead 48 to a second precharge means 60. This second precharge means controls the placing of a charge on electrode 44 from a voltage source (not shown in FIG. 1). This voltage source can be the same voltage source which supplies the voltage, $V_0$, to the first precharge means.

Electrodes 36 and 44 are situated on substrate 10 such that a charge flow channel 78 is formed beneath electrodes 36 and 44.

First and second precharge means (50 and 60 respectively) are comprised of electrical switches, preferably field effect transistors. FET switch 50 has its drain 52 connected to the voltage source which supplies voltage $V_0$, while source 54 is connnected to electrode 36 by lead 40. FET switch 50 has gate 56 coupled to receive a clock signal $V_{pc}$. FET switch 60 has drain 62 also connected to the voltage source supplying voltage $V_0$, while source 64 is connected to electrode 44 by lead 48. FET switch 60 has gate 66 also coupled to receive clock signal $V_{pc}$.

A third charge transfer means is formed on substrate 10 adjacent electrode 44. This third charge transfer means comprises electrodes 70 and 74. Electrodes 70 and 74 are insulated from substrate 10 by layer 20 and may be of the same construction as electrode 12, 16, 24, 28, 36 and 44. Electrode 70 is located on substrate 10 between and adjacent electrodes 44 and 74 above charge flow channel 78. Electrode 70 is coupled by lead 72 to receive clock signal $V_{XO}$ while electrode 74 is coupled by lead 76 to receive clock signal $V_S$.

Figure 2:
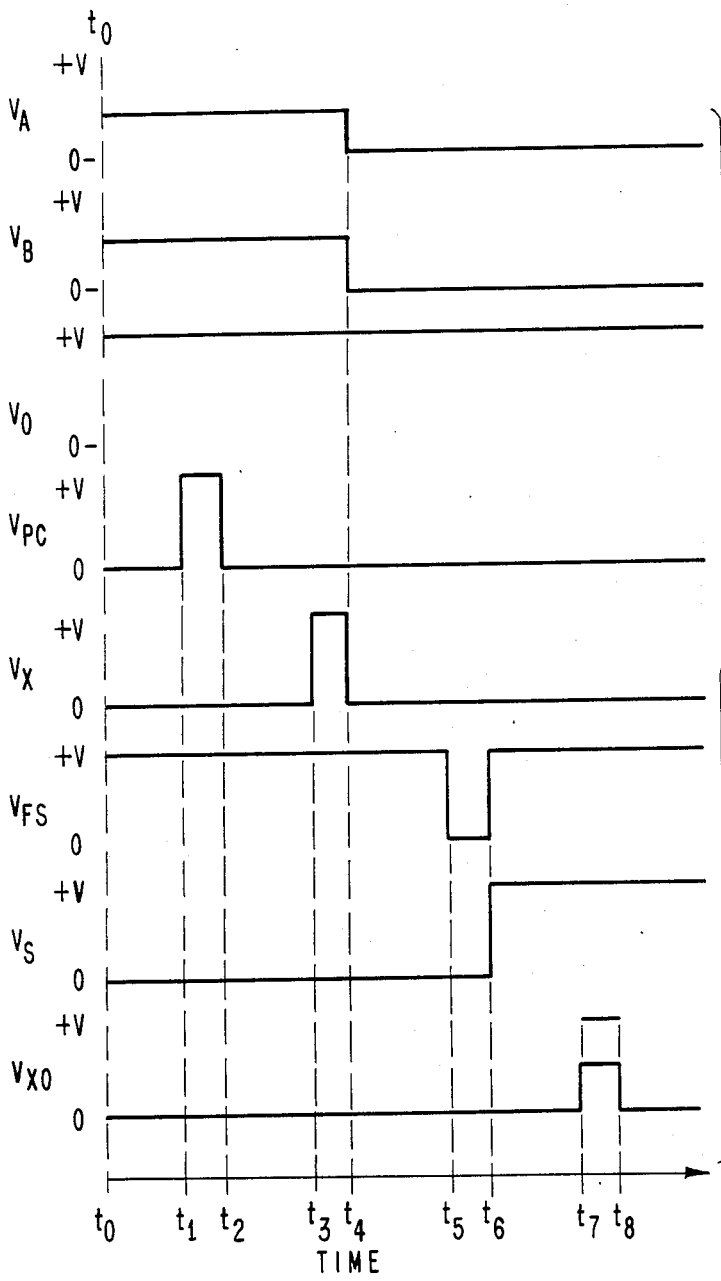
FIG. 2 illustrates the waveform of voltages applied to the charge coupled device differencer illustrated in FIG. 1.
Figure 3:
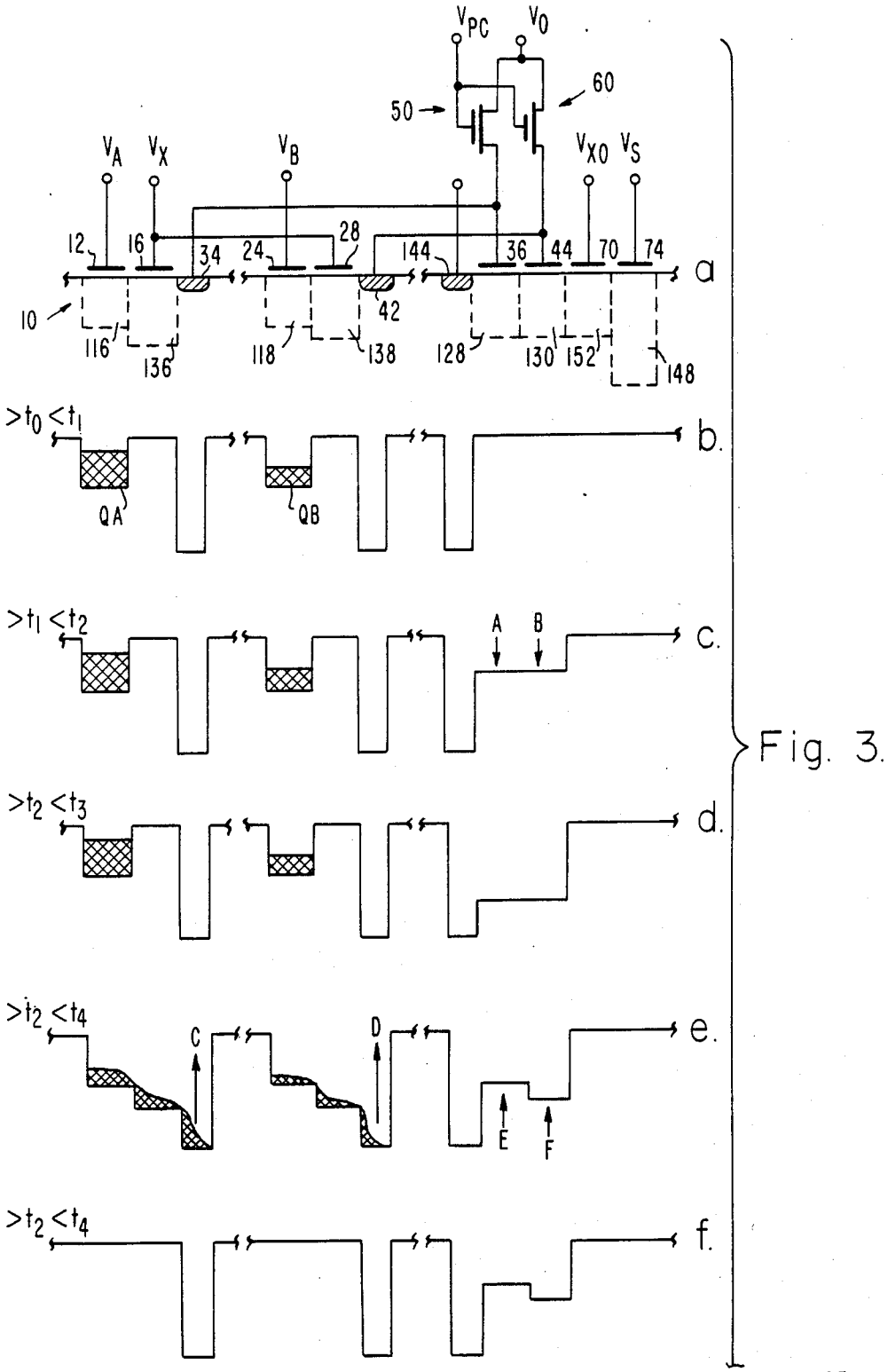

Referring to FIGS. 2 and 3, the operation of the present invention is described for subtraction of a smaller charge packet $Q_B$ from a larger charge packet $Q_A$.

At a time prior to $t_o$, clock signals $V_A$ and $V_B$ are clocked "high," thus applying positive voltages to input electrodes 12 and 24. The applied voltages cause input potential wells 116 and 118 to form beneath electrodes 12 and 24 in substrate 10. Charge packets $Q_A$ and $Q_B$ are then respectively shifted into input potential wells 116 and 118 by means well known to those skilled in the art.

During the time period $t_o$ to $t_1$, as shown in FIG. 3*b*, charge packet $Q_A$ resides in input potential well 116 beneath electrode 12 while charge packet $Q_B$ resides in input potential well 118 beneath electrode 24. FIG. 3*c* illustrates the time period $t_1$ to $t_2$ as clock signal $V_{pc}$ is applied to switches 50 and 60. Upon clock signal $V_{pc}$ going from "low" to "high," i.e., zero to a higher potential, switches 50 and 60 change from the non conducting to the conducting state. With switches 50 and 60 in the conducting state, voltage $V_0$ from an external voltage source (not shown) is placed on charge subtraction electrodes 36 and 44. This application of voltage $V_0$ to electrodes 36 and 44 places a charge on electrodes 36 and 44. The charge on electrodes 36 and 44 causes the formation of charge subtractor potential wells 128 and 130 (illustrated by arrows A and B in FIG. 3*c*), respectively, beneath electrodes 36 and 44 in substrate 10 in proportion to voltage $V_0$.

FIG. 3*d* illustrates the time period from $t_2$ to $t_3$. At time $t_2$, clock signal $V_{pc}$ goes "low", thus placing switches 50 and 60 in the non-conducting state with a charge remaining on electrodes 36 and 44. Potential wells 128 and 130 exist beneath electrodes 36 and 44 even after the removal of voltage $V_0$ from electrodes 36 and 44 because of the charge that remains on electrodes 36 and 44. Electrodes 36 and 44 are constructed such that the surface area of electrode 36 is represented by $A_1$ while that of electrode 44 is represented by $A_2$. The charge on electrode 36, $Q_{E1}$, is given by the following relationship:

$$Q_{E1} = A_1 \sqrt{\theta \psi_{S1}} \tag{1}$$

where $\theta = 2_q N_A E_S$ and $E_S$=dielectric constant of silicon $\psi_{S1}$=surface potential under electrode 36.

Similarly, the charge on electrode 44, $Q_{E2}$, is given by the following relationship:

$$Q_{E2} = A_2 \sqrt{\theta \psi_{S2}} \tag{2}$$

$\psi_{S2}$=surface potential under electrode 44.

Since the surface potential under electrodes 36 and 44 is the same for $\psi_{S1}=\psi_{S2}$, equations (1) and (2) can be reduced to the following equation:

$$Q_{E1} = \frac{A_1}{A_2} Q_{E2} \tag{3}$$

During the time period $t_3$ to $t_4$ of FIG. 2 and FIG. 3*e*, $V_X$, applied to charge transfer electrodes 16 and 28, goes from "low" to "high". In FIG. 3*e* the "high" $V_X$ clock signal applied to electrodes 16 and 28 causes charge transfer potential wells 136 and 138 to be formed respectively under electrodes 16 and 28. Diffusion 34, located in substrate 10 adjacent potential well 136, is electrically connected to electrode 36 which has charge $Q_{E1}$ thereupon. Diffusion 42, located in substrate 10 adjacent potential well 138, is electrically connected to electrode 44 which has charge $Q_{E2}$ thereupon. As potential wells 136 and 138 are being formed, charge packets $Q_A$ and $Q_B$ begin to spill respectively into potential wells 136 and 138.

As charge packet $Q_A$ spills into potential well 136, the minority charge carriers comprising charge packet $Q_A$ are attracted into diffusion 34 (illustrated by arrow C in FIG. 3*e*). Since diffusion 34 is electrically connected to electrode 36, the minority charge carriers of charge packet $Q_A$ begin to recombine with the charge on electrode 36, $Q_{E1}$. Similarly, the minority charge carriers of charge packet $Q_B$ spill into potential well 138 and are attracted into diffusion 42 (illustrated by arrow D in FIG. 3*e*). Since diffusion 42 is electrically connected to electrode 44, the minority charge carriers of charge packet $Q_B$ begin to recombine with the charge on electrode 44, $Q_{E2}$. The recombination of minority charge carriers with the charge on electrodes 36 and 44 causes a reduction in charge thereupon equal to the quantity of minority charge carriers present in charge packets $Q_A$ and $Q_B$. The reduced charge on electrode 36, $Q_{E1}'$, is given by the following equation:

$$Q_{E1}' = Q_{E1} - Q_A \tag{4}$$

and the reduced charge on electrode 44, $Q_{E2}'$ is given by the following equation:

$$Q_{E2}' = Q_{E2} - Q_B \tag{5}$$

Hence, the reduction of charge on electrode 36 and 44 reduces the level of potential wells 128 and 130 (illustrated by arrows E and F in FIG. 3*e*) from the initial precharge level. The charge on electrode 36 reduces more than the charge on electrode 44 since $Q_A$ was greater than $Q_B$, thus $Q_{E1}'$ is less than $Q_{E2}'$.

During the time period $t_4$ to $t_5$, clock signals $V_A$ and $V_B$ go from "high" to "low" thus eliminating potential wells 116 and 118 below electrodes 12 and 24 (illustrated in FIG. 3*f*). Clock signal $V_X$ also goes from "high" to "low" thus eliminating potential wells 136 and 138 below electrodes 16 and 28 (also illustrated in FIG. 3*f*). Electrode 36 has charge $Q_{E1}'$ on it with a proportional potential well beneath it as does electrode 44 with charge $Q_{E2}'$ thereupon.

During time period $t_5$ to $t_6$, in FIG. 2, clock signal $V_{FS}$, which has been held "high" throughout the time period $t_0$ to $t_5$, goes "low". Clock signal $V_{FS}$ is applied to diffusion 144 (a reservoir of charge) which is located in substrate 10 adjacent potential well 128. By holding $V_{FS}$ "high", charge carriers are attracted into diffusion 144. When $V_{FS}$ goes "low" at $t_5$, charge carriers flow from diffusion 144 into potential wells 128 and 130 (illustrated in FIG. 3*g* by arrow G).

During time period $t_6$ to $t_7$ in FIG. 2, clock signal $V_{FS}$ returns "high" thereby making diffusion 144 attractive to charge carriers in potential wells 128 and 130. Charge carriers in potential wells 128 and 130 flow back into diffusion 144 (illustrated by arrow H in FIG. 3*h*). However, since potential well 128 was reduced more than potential well 130, a portion of the charge carriers are trapped in potential well 130 by a barrier created by potential well 128. The charge carriers trapped in potential well 130 form charge packet $Q_C$. Charge packet $Q_C$ represents the algebraic difference of $Q_A - Q_B$. In addition, the amount of charge carriers trapped in potential well 130 is exactly the amount causing $\psi_{S1}' = \psi_{S2}'$. The following equations illustrate the above result:

$$Q_{E1}' = Q_{E1} - Q_A = A_1\sqrt{\theta\psi_S'} \quad (6)$$

and $$Q_{E2}' = Q_{E2} - Q_B = A_2\sqrt{\theta\psi_S'} + Q_C \quad (7)$$

so that $$Q_C = Q_{E2} - Q_B - \frac{A_2}{A_1}[Q_{E1} - Q_A] \quad (8)$$

or $$Q_C = \frac{A_2}{A_1}Q_A - Q_B \text{ since } \frac{A_1}{A_2}Q_{E2} = Q_{E1} \quad (9)$$

or $$Q_C = \alpha Q_A - Q_B \quad (10)$$

where $$\alpha = \frac{A_2}{A_1} \quad (11)$$

Also during the time period $t_6$ to $t_7$ clock signal $V_S$ which was previously held "low", goes "high." Clock signal $V_S$, applied to electrode 74, goes "high" thus causing output potential well 148 to be formed in substrate 10 beneath electrode 74 (illustrated by arrow I in FIG. 3*h*).

During time period $t_7$ to $t_8$, clock signal $V_{XO}$ which was previously held "low" goes "high." Clock signal $V_{XO}$, applied to electrode 70, going "high" causes output potential well 152 to be formed in substrate 10 beneath electrode 70. Electrode 70 is located between electrode 44 and 74. The formation of potential well 152 enables charge packet $Q_C$ to flow from potential well 130 into potential well 148 (as shown in FIG. 3*i*).

At time period $t_8$, clock signal $V_{XO}$ returns to a "low" potential, thus eliminating potential well 152 beneath electrode 70. However, $V_S$ remains "high" with charge packet $Q_C$ held in potential well 148. Charge packet $Q_C$ may then be shifted beneath other electrodes, by means known, for further processing.

Returning to equations (10) and (11), it can be seen that if the primary electrode areas $A_1=A_2$ then $Q_C=Q_A-Q_B$. However, if $A_2$ is greater than $A_1$ then the value of the resultant charge packet $Q_C$ would reflect the amplification factor of $A_2/A_1$ to $Q_A$. Thus, the present invention may function as a charge packet replicator with with an amplification factor of $A_2/A_1$ if charge packet $Q_B$ equals zero, i.e., no charge packet. Furthermore, if potential well 148 is not emptied after successive cycles of charge packet subtraction, an output charge packet from potential well 148 would represent the sum of succesive charge packet subtractions, i.e.:

$$\sum_{n=1}^{n=x}\frac{A_2}{A_1}Q_A - Q_B \quad (12)$$

where x=number of successive cycles.

The previous operational description was based on the fact that charge packet $Q_A$ was greater than charge packet $Q_B$. If charge packet $Q_B$ were greater than charge packet $Q_A$, there would be no resultant output charge packet, i.e., $Q_C=0$. The operation of the present invention with charge packet $Q_B$ subtracted from a smaller charge packet $Q_A$, using the clocking signals of FIG. 2, is briefly explained. The difference in operation occurs during the period $t_3$ to $t_4$ where charge packets $Q_A$ and $Q_B$ minority carriers respectively recombine with the charge on electrode 36 or 44. Since charge packet $Q_B$ is greater than charge packet $Q_A$, the level of potential well 130 reduces more than the level of potential well 128. When diffusion 144 receives the "low" clock signal $V_{FS}$, charge carriers flow into potential wells 128 and 130 as previously described. During the time period $t_6$ to $t_7$, when diffusion 144 receives the "high" clock signal $V_{FS}$, all charge carriers return to diffusion 144. Potential well 128 is not a barrier to trap charge carriers in potential well 130 since potential well 128 is reduced more than potential well 130. Thus no charge packet remains in potential wells 128 and 130 to represent the difference between charge packets $Q_A$ and $Q_B$.

The preferred embodiment of the present invention, comprising a novel charge coupled device differencer, has been disclosed. Various modifications to this embodiment will readily be apparent to those skilled in the art without exercise of the inventive faculty, and the generic principles defined herein may be applied to other embodiments. For example, it is apparent that the present invention could also be fabricated using a buried channel GaAs substrate. Thus, the present invention is not intended to be limited to the embodiment illustrated herein, but is to be accorded the widest scope consistent with the principles and novel features disclosed herein.

What is claimed is:

1. A charge coupled device differencer comprising:

a semiconductor substrate (10);

first charge transfer means (12 and 16) formed on said substrate for receiving and transferring a first quantity of charge carriers;

second charge transfer means (24 and 28) formed on said substrate for receiving and transferring a second quantity of charge carriers;

a first charge subtraction means (34 and 36) coupled to said first charge transfer means and responsive to said first quantity of charge carriers so as to form a first potential well in said substrate having a level determined by said first quantity of charge carriers;

second charge subtraction means (42 and 44) coupled to said second charge transfer means and responsive to said second quantity of charge carriers so as to form a second potential well in said substrate having a level determined by said second quantity of charge carriers; and charge reservoir means (144) for injecting a third quantity of charge carriers into said first and second potential wells and for removing a fourth quantity of charge carriers from said first and second potential wells, said fourth quantity of charge carriers being less than said third quantity of charge carriers when said first quantity of charge carriers is greater than said second quantity of charge carriers whereby the difference between said third and fourth quantity of charge carriers remains in said second potential well and represents the difference between said first and second quantity of charge carriers.

2. The charge coupled device differencer of claim 1 wherein said first charge subtraction means comprises:

a first diffusion (34) disposed in said substrate adjacent said first charge transfer means; and a first electrode (36) overlying said substrate adjacent said charge reservoir means, said first electrode being electrically connected to said first diffusion.

3. The charge coupled device differencer of claim 2 wherein said second charge substraction means comprises:

a second diffusion (42) disposed in said substrate adjacent said second charge transfer means; and a second electrode (44) overlying said substrate adjacent said first electrode, said second electrode being electrically connected to said second diffusion.

4. The charge coupled device differencer of claim 3 further comprising first and second precharge means (50 and 60) said first precharge means connected to said first charge subtraction means so as to place a first charge on said first electrode (36) and said second precharge means connected to said second charge subtraction means so as to place a second charge on said second electrode (44).

5. The charge coupled device differencer of claim 4 wherein said first and second precharge means comprise first and second electrical switches, said first electrical switch (50) coupled between said first electrode and a voltage source ($V_O$) and said second electrical switch coupled between said second electrode and said voltage source.

6. The charge coupled device differencer of claim 5 wherein said first electrical switch comprises a first transistor having its source and drain connected between said first electrode (36) and said voltage source ($V_O$) and said second electrical switch comprises a second transistor having its source and drain connected between said second electrode (44) and said voltage source.

7. The charge coupled device differencer of claim 3 further comprising a third charge transfer means (70 and 74) formed on said substrate adjacent said second electrode (44) for receiving and transferring said fourth quantity of charge carriers from said second electrode.

8. The charge coupled device differencer of claim 7 wherein said third charge transfer means comprises seventh (70) and eighth (74) electrodes overlying said substrate with said seventh electrode located adjacent and between said second and eighth electrodes.

9. The charge coupled device differencer of claim 1 wherein said first charge transfer means comprises:

a third electrode (12) overlying said substrate; and a fourth electrode (16) overlying said substrate located between said third electrode and said first diffusion (34).

10. The charge coupled device differencer of claim 9 wherein said second charge transfer means comprises:

a fifth electrode (24) overlying said substrate; and a sixth electrode (28) overlying said substrate located between said fifth electrode and said second diffusion (42).

11. The charge coupled device differencer of claim 1 wherein said charge reservoir means comprises a third diffusion (144) disposed in said substrate adjacent said first electrode (36).

12. A charge coupled device differencer comprising:

a semiconductor substrate;

first and second input electrodes overlying and insulated from said substrate, said first input electrode (12) responsive to a first clock signal ($V_A$) so as to form a first input potential well (116) in said substrate beneath said first input electrode, said first input potential well for holding a first charge packet ($Q_A$), and said second input electrode (24) responsive to a second clock signal ($V_B$) so as to form a second input potential well (118) in said substrate beneath said second input electrode, said second input potential well for holding a second charge packet ($Q_B$);

first and second charge transfer electrodes overlying and insulated from said substrate, said first charge transfer electrode (16) located adjacent said first input electrode and said second charge transfer electrode (28) located adjacent said second input electrode, said first and second charge transfer electrodes responsive to a third clock signal ($V_X$) so as to form a first charge transfer potential well (136) in said substrate beneath said first charge transfer electrode, said first charge transfer potential well for receiving said first charge packet ($Q_A$) from said first input potential well, and so as to form a second charge transfer potential well (138) in said substrate beneath said second charge transfer electrode, said second charge transfer potential well for receiving said second charge packet ($Q_B$) from said second input potential well;

first and second diffusions located in said substrate, said first diffusion (34) being adjacent the area below said first charge transfer electrode and said second diffusion (42) being adjacent the area below said second charge transfer electrode, said first diffusion for receiving said first charge packet ($Q_A$) from said first charge transfer potential well and said second diffusion for receiving said second charge packet ($Q_B$) from said second charge transfer potential well;

first and second charge subtractor electrodes overlying and insulated from said substrate, said first charge subtractor electrode having a first surface area ($A_1$) and being connected to said first diffusion, said second charge subtractor electrode having a second surface area ($A_2$) and being connected to said second diffusion;

first and second transistor switches each having a source connected to receive a voltage ($V_0$), a drain respectively connected to said first and second charge subtractor electrodes, and a gate connected to receive a fourth clock signal ($V_{pc}$) so as to place a first charge on said first charge subtractor electrode and a second charge on said second charge subtractor electrode such that a first charge subtractor potential well (128) is formed in said substrate beneath said first charge subtractor electrode and a second charge subtractor potential well (130) is formed in said substrate beneath said second charge subtractor electrode;

a third diffusion (144) located in said substrate adjacent the area below said first charge subtractor electrode, said third diffusion responsive to a fifth clock signal ($V_{FS}$) so as to fill said first and second charge subtractor potential wells (128 and 130) with a third charge packet, then remove a portion of said third charge packet such that a fourth charge packet ($Q_C$) remains in said second charge subtractor potential well (130) where $Q_C$ equals the difference between $Q_A$ and $Q_B$ when $Q_A$ is greater than $Q_B$ and said third diffusion removes the entire third charge packet from said first and second charge subtractor potential wells when $Q_B$ is greater than $Q_A$; and first and second output electrodes overlying and insulated from said substrate, said first output electrode (70) located between and adjacent said second charge subtractor electrode and said second output electrode (74), said first output electrode being responsive to a sixth clock signal ($V_{XO}$) so as to form a first output potential well (152) in said substrate beneath said first output electrode to receive said third charge packet ($Q_C$) from said second charge subtractor potential well and said second output electrode being responsive to a seventh clock signal ($V_{ST}$) so as to form a second output potential well (148) in said substrate beneath said second output electrode to receive said third charge packet ($Q_C$) from said first output potential well.

13. The charge coupled device differencer of claim 12 wherein said substrate is p-type silicon and said first, second, and third diffusions are n+ doped silicon.

14. The charge coupled device differencer of claim 13 wherein said first and second input electrodes, said first and second charge transfer electrodes, said first and second charge subtractor electrodes, and said first and second output electrodes are insulated from said substrate by a thin insulating layer formed on said substrate between said electrodes and said substrate.

15. The charge coupled device differencer of claim 14 wherein said insulating layer is formed from silicon dioxide.

16. The charge coupled device differencer of claim 13 wherein said first and second input electrodes, said first and second charge transfer electrodes, said first and second charge subtractor electrodes, and said first and second output electrodes are formed of aluminum and polysilicon.

17. A method of subtracting a first charge packet from a second charge packet comprising the steps of:

(a) providing a semiconductor substrate having first and second charge transfer means, first and second charge subtraction means, and charge reservoir means;

(b) inputting a first charge packet into said first charge transfer means;

(c) inputting a second charge packet into said second charge transfer means;

(d) applying a voltage to said first and second charge subtraction means to respectively form first and second potential wells;

(e) transferring said first charge packet into said first charge subtraction means so as to adjust the level of said first potential well in proportion to said first charge packet;

(f) transferring said second charge packet into said second charge subtraction means so as to adjust the level of said second potential well in proportion to said second charge packet;

(g) inputting a third charge packet into said first and second potential wells by said charge reservoir means; and (h) removing a fourth charge packet from said first and second potential wells by said charge reservoir means such that said fourth charge packet is less than said third charge packet when said first charge packet is greater than said second charge packet so that a fifth charge packet remains in said first potential well, said fifth charge packet being the difference between said third and fourth charge packets and representing the difference between said first and second charge packets.

18. The method of subtracting a first charge packet from a second charge packet of claim 17 further comprising the step of:

(a) providing said semiconductor substrate with a third charge transfer means; and (b) transferring said fifth charge packet out of said first potential well by said third charge transfer means.

* * * * *